United States Patent [19]

Smith

[11] 4,415,152

[45] Nov. 15, 1983

[54] BICYCLE TRAINING AND EXERCISE DEVICE

[76] Inventor: Sebie B. Smith, 1252 Peachtree St., Montgomery, Ala. 36106

[21] Appl. No.: 296,984

[22] Filed: Aug. 27, 1981

[51] Int. Cl.[3] ..... A63B 69/16; A63B 23/06

[52] U.S. Cl. ..... 272/73; 434/247

[58] Field of Search ..... 272/73; 434/247, 255; 128/25 R; 280/228, 293, 294, 295, 296, 297; 33/391, 399

[56] References Cited

U.S. PATENT DOCUMENTS

| | | | |
|---|---|---|---|
| 554,754 | 2/1896 | Webber | 272/73 |
| 602,546 | 4/1898 | Tarver | 272/73 |
| 604,200 | 5/1898 | Vogeler | 272/73 |
| 1,301,925 | 4/1919 | Farthing | 33/391 |
| 2,623,302 | 12/1952 | Shields | 272/73 UX |

FOREIGN PATENT DOCUMENTS

| | | | |
|---|---|---|---|
| 99657 | 10/1898 | Fed. Rep. of Germany | 272/73 |
| 104349 | 12/1898 | Fed. Rep. of Germany | 272/73 |
| 4417 | of 1895 | United Kingdom | 272/73 |
| 7531 | of 1897 | United Kingdom | 272/73 |
| 12834 | of 1901 | United Kingdom | 272/73 |

*Primary Examiner*—Robert A. Hafer
*Assistant Examiner*—Arnold W. Kramer
*Attorney, Agent, or Firm*—Newton, Hopkins & Ormsby

[57] ABSTRACT

A conventional bicycle is mounted and restrained for exercise and/or rider training with safety. When released, the bicycle can be used in a normal manner. A moving roller supported beltway for the front wheel only of the bicycle closely simulates a true roadway surface and may be powered by the rear traction wheel of the bicycle or by an independent drive device. A flexible lateral restraining system for the bicycle limits its lateral tilting within safe limits, and in cooperation with side longitudinal guide elements for the bicycle wheels, close to the edges and level of the beltway, prevents a rider from deviating from the boundaries of the beltway. A frame of the restraining means can serve as a hand support for walkers or joggers utilizing the beltway.

4 Claims, 3 Drawing Figures

BICYCLE TRAINING AND EXERCISE DEVICE

BACKGROUND OF THE INVENTION

In the prior art, a number of devices are known to enable the use of a regular bicycle for rider training indoors and/or for exercise at a stationary point, without effecting the use of the bicycle in a normal manner for regular purposes when released.

The object of this invention is to improve on the prior art devices in a number of ways. More particularly, this invention seeks to provide a bicycle rider training and exercise unit of increased utility over the prior art, of greater simplicity, and, more importantly, more closely simulating actual bicycle riding conditions and "feel" without sacrificing safety.

In achieving this last objective, a moving beltway for the front wheel only of the mounted bicycle is provided and is powered by the rear wheel of the bicycle which engages the rear portion of the belt above the lowermost portion of the rear wheel or, alternatively, by a separate drive motor.

Additionally, the training device by virtue of its construction is adapted to receive bicycles of a range of dimensionally different wheel bases and heights.

A unique lateral restraining system to limit tilting of the bicycle and also limit its lateral deviation within the boundaries of the beltway includes flexible elements attached to the frame of the bicycle near seat level, and lower level longitudinal wheel guidance and restraining rollers near the opposite longitudinal edges of the beltway and at a low level adjacent to each bicycle wheel.

In accordance with a further objective of the invention, the upright frame of the lateral restraining means may also serve as a hand bar or support for a jogger or walker who utilizes the level beltway for exercise when the bicycle is not in place.

A simple inclinometer of any preferred type attached to the bicycle can assist a beginner in a training program by indicating which way to steer the bicycle to maintain proper balance.

A power means is provided on the device to impart relative motion to the bicycle for development of rider balance and control skills.

All of the above features and objectives are achieved in the invention with great simplicity of construction, compactness of mechanism, and comparatively low manufacturing cost.

Other features and advantages of the invention will become apparent during the course of the following detailed description.

DETAILED DESCRIPTION

Figure 1:
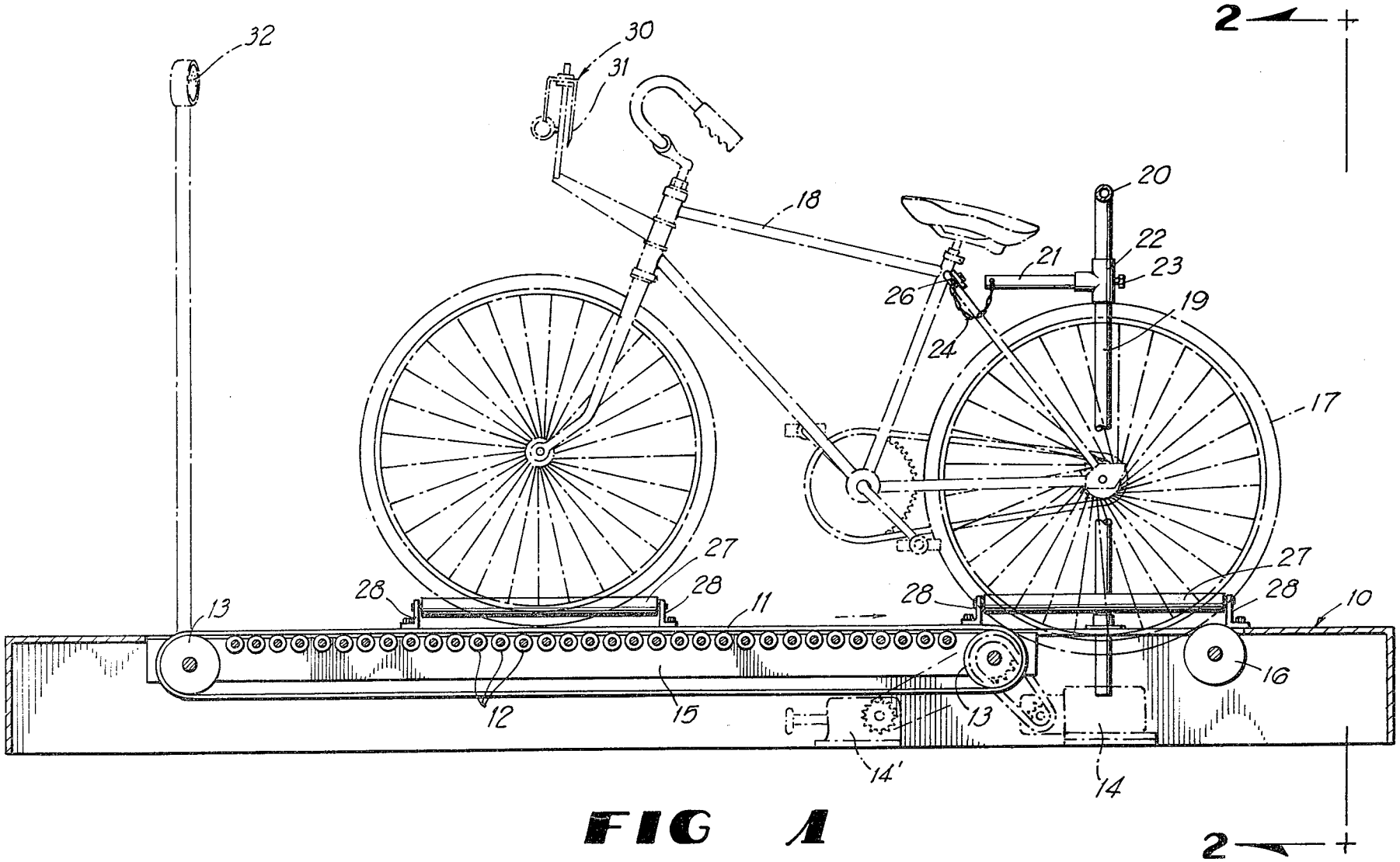
FIG. 1 is a side elevation, partly in section, of a bicycle training and exercise device according to the invention.
Figure 2:
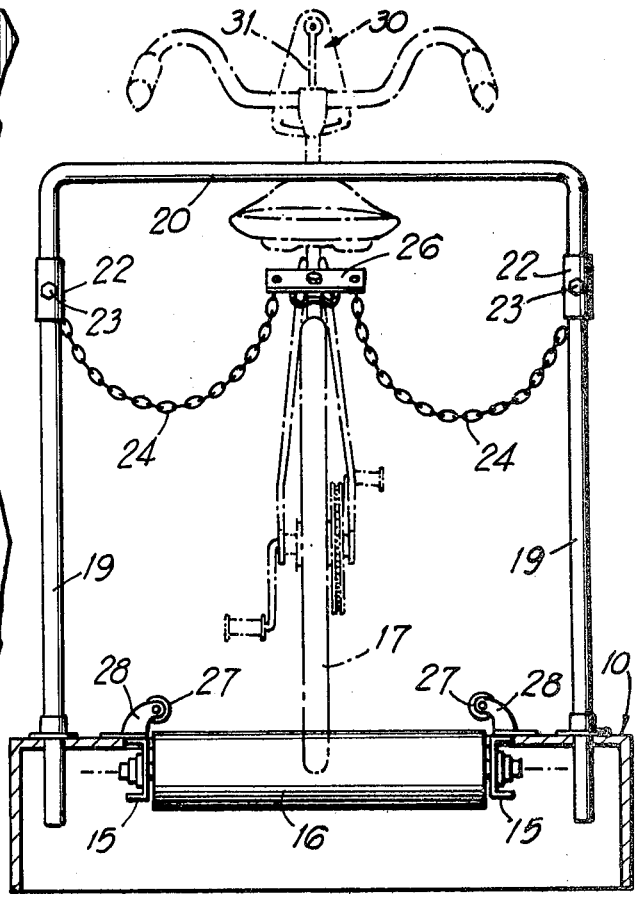
FIG. 2 is a vertical section taken on line 2—2 of FIG. 1.
Figure 3:
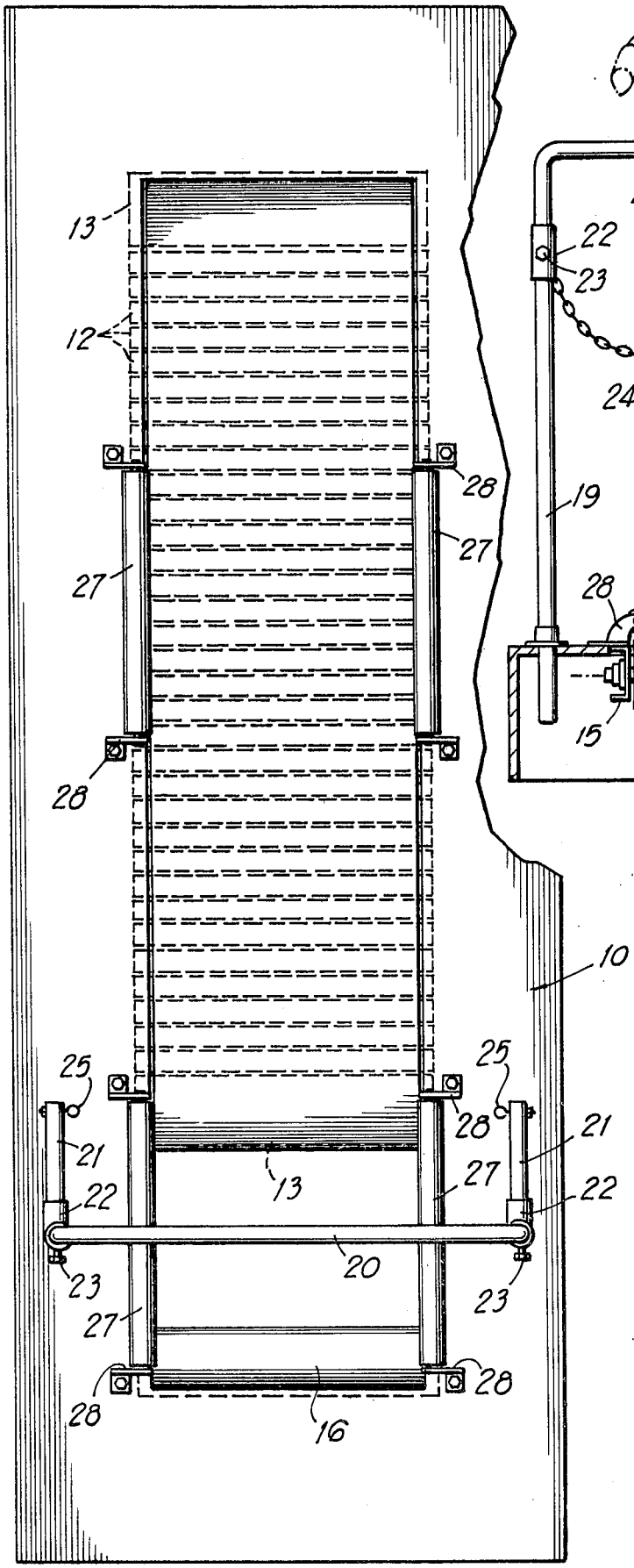
FIG. 3 is a plan view of the device with parts omitted and parts broken away.

Referring to the drawings in detail wherein like numerals designate like parts, a bicycle training and exercise device comprises a hollow elongated base 10 having a horizontal top wall and adapted to rest on a level support surface. Extending longitudinally of the base 10 for a major portion of its length is a horizontal moving beltway consisting of an endless moving belt 11 and a supporting closely spaced plurality of rollers 12 beneath the top run of the belt 11. The belt 11 is trained over front and rear guide rolls 13 and the rear roll 13 may, in some cases, be powered by a drive motor 14 as indicated in phantom lines in FIG. 1 according to an option. Also phantomed in FIG. 1 is a tensioning device 14' chained to rear guide roll 13 which is tensioned through a hand wheel to apply a force against the roller 13 which is transmitted to the bicycle in its exercise mode, this also is an optional device.

The roller beltway, above described, is contained within an opening provided in the top wall of the base 10 so that the top run of the belt 11 is essentially flush with or slightly above the top wall of the base. The rolls 12 and 13 are supported on a pair of sturdy parallel longitudinal channel rails 15 within the base 10, as shown.

Near the rear end of the base 10, another transverse roller 16 preferably of the same diameter as the belt guidance rollers 13 is supported in the base 10 at substantially the same elevation as the two rollers 13. The rear roller 13 and the roller 16 are spaced apart on parallel axes to produce a roller support bed for the rear traction wheel 17 of a standard bicycle 18 which is employed for exercise and/or rider training at a fixed location and with complete safety. The rear traction wheel 17 by friction can power the belt 11 to move rearwardly beneath the bicycle front wheel in lieu of the drive motor 14. The use of a motor may be preferable with beginner riders or with those who may not possess the power to drive the beltway. In either case, the rear wheel 17 remains safely cradled in its two roller support bed and the movement of the belt under the front wheel only of the bicycle closely simulates actual riding conditions and "feel" in accordance with a main feature of the invention.

Safe and simplified means to restrain the bicycle laterally within the boundaries of the belt 11 and to limit its tilting are provided. Such means includes an upright inverted U-shaped rigid frame 19 including a top horizontal bar 20 arranged midway between the rollers 16 and 13 and extending to an elevation substantially even with the seat of a full size bicycle. The frame 19 is suitably rigidly supported on the base 10 and may be rendered vertically adjustable, if desired.

A pair of relatively short horizontal longitudinal restraint arms 21 project forwardly from the two sides of the frame 19 and are held in T-fittings 22 having locking set screws 23, whereby the two arms 21 can be vertically adjusted and locked on the frame 19 to properly accommodate bicycles of different heights. Restraint chains 24 of equal lengths are attached to the forward ends of the arms 21, as by eye bolt 25, and have their other ends attached to a plate 26 which is removably clampingly attached to the frame of the bicycle 18 near and under its seat.

The chains 24 have sufficient slack to enable realistic steering and tilting of the bicycle for training purposes but limit tilting within safe limits without any effects on the bicycle or rider until a full tilt condition has been reached.

As a further safety and restraint, pairs of parallel longitudinal wheel restraint rollers 27 are positioned adjacent to the two wheels of the bicycle and near and slightly above the top run of the belt 11 at the opposite longitudinal edges of the belt. The rollers 27 are supported by brackets 28 which are attached to the base 10. The rollers 27 prevent steering the bicycle off of the moving belt 11 and also prevent the possibility of the bicycle wheels skidding off of the belt and off of the two roller bed for the rear traction wheel 17. The length of rollers 27 along the belt 11 enable the device to accept bicycles of dimensionally different wheel base.

As suggested previously, an inclinometer 30 can be attached to the bicycle 18 in view of a training rider to indicate via arrow 31 to the rider that the handle bars should be turned in the direction that is indicated by arrow 31 in order to upright and steer out of a tilting condition and regain proper balance and control.

Also a mileage indicator 32 may be an optional feature.

It is now apparent that the invention can provide excellent safe rider training and exercise for a user who does not wish to go outdoors for an actual bicycle ride for various reasons. At the same time, the device in no way restricts the use of the bicycle in a customary manner once the clamping plate 26 is released.

With the bicycle removed from the device, an exercising walker or jogger can place his or her feet on the belt 11 while facing rearwardly toward the frame 19. Such person can grasp the horizontal bar 20 for stability while exercising. Thus, the invention has dual utility as an exercising apparatus, and this feature is not provided by the prior art mechanisms. Compared to the prior art, the invention is simpler in construction, more compact, safer and more realistic in simulating a bicycle ride over a typical roadway.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A bicycle rider training device also adapted for use as an exerciser for walkers or joggers comprising a low elevation level base, a level moving beltway on the base extending lengthwise of the base for a major portion of the length of the base, said beltway comprising an endless belt having a top run substantially flush with the top of the base, a series of spaced transverse axis support rollers for said upper run preventing it from sagging, a pair of forward and rear guide rolls engaging opposite ends of the endless belt, power means to drive the rear drive roll in a direction causing movement of the top run of the belt toward the rear of said base, a transverse axis idler roll on the base near its rear end and spaced rearwardly of and being substantially at the elevation of the rear guide roll for the endless belt, whereby the rear wheel of a conventional bicycle may be cradled on the idler roll and the rear of the endless belt as it passes around said rear guide roll for the belt, forward and rear pairs of laterally spaced parallel horizontal longitudinal axis bicycle wheel restraint rollers mounted on said base, said wheel restraint rollers all being at one elevation slightly above the level of the top of the base and top run of the endless belt, the rollers of each pair being disposed adjacent to and parallel to the opposite longitudinal edges of the belt to prevent the wheels of a bicycle from leaving the lateral confines of the belt, the rear pair of wheel restraint rollers being disposed immediately above the rear guide roll for the belt and said rear idler roll, the lengths of the wheel restraint rollers in said pairs and the longitudinal spacing of said pairs enabling all sizes of conventional bicycles to have their front and rear wheels placed between the forward and rear pairs of restraint rollers, an upright inverted U-shaped substantially rigid frame including side vertical bars and a top transverse bar disposed substantially midway between the rear idler roll and the rear guide roll for said belt, said substantially vertical bars being anchored to said base at points spaced laterally outwardly of the side longitudinal edges of the endless belt, said top transverse bar being at a sufficient elevation above the base to form a convenient hand grip for a walker or jogger whose feet are placed on the top run of said belt, a pair of comparatively short horizontal longitudinal arms on the vertical bars projecting forwardly thereof, coupling carrying said arms and being adjustable and lockable at desired elevations on the vertical bars so that the heights of said arms may be varied, a clamp plate adapted for attachment removably to the frame of a bicycle near and below the seat thereof, and a pair of equal length flexible substantially non-stretchable restraint elements connected between opposite ends of said clamp plate and said adjustable arms, whereby lateral tilting of a bicycle is restrained within safe limits during use of the device.

2. A bicycle rider training device as defined in claim 1, and said restraint elements comprising a pair of chains.

3. A bicycle rider training device as defined in claim 1, and said couplings carrying said arms comprising tubular T-couplings, the vertical sleeves of the T-couplings being slidably mounted on said vertical bars, and locking set screws carried by said vertical sleeves and being clampingly engageable with the vertical bars.

4. A bicycle rider training device as defined in claim 1, and an inclinometer attachment adapted to be mounted on a bicycle and serving to indicate to a rider the need for steering the bicycle in a direction to compensate for lateral tilting.

* * * * *